US009928676B2

(12) United States Patent
Rambadt et al.

(10) Patent No.: US 9,928,676 B2
(45) Date of Patent: Mar. 27, 2018

(54) FIREARM STORAGE RECEPTACLE WITH ALERT NOTIFICATION FOR EMERGENCY PERSONNEL

(71) Applicants: John Rambadt, Gravette, AR (US); Eric Rambadt, Fort Smith, AR (US)

(72) Inventors: John Rambadt, Gravette, AR (US); Eric Rambadt, Fort Smith, AR (US)

(73) Assignee: John Rambadt, Gravette, AR (US)

( * ) Notice: Subject to any disclaimer, the term of this patent is extended or adjusted under 35 U.S.C. 154(b) by 0 days.

(21) Appl. No.: 15/441,767

(22) Filed: Feb. 24, 2017

(65) Prior Publication Data

US 2017/0243427 A1 Aug. 24, 2017

Related U.S. Application Data

(60) Provisional application No. 62/299,079, filed on Feb. 24, 2016.

(51) Int. Cl.

| | |
|---|---|
| ***G07C 9/00*** | (2006.01) |
| ***G08B 25/12*** | (2006.01) |
| ***B05B 9/01*** | (2006.01) |
| ***B05B 12/12*** | (2006.01) |

(52) U.S. Cl.

CPC ..... *G07C 9/00912* (2013.01); *B05B 9/01* (2013.01); *B05B 12/12* (2013.01); *G07C 9/00158* (2013.01); *G07C 9/00563* (2013.01); *G08B 25/12* (2013.01)

(58) Field of Classification Search

CPC ..... G07C 9/00912; G07C 9/00158; G07C 9/00563; B05B 9/01; B05B 9/12; G08B 25/12

See application file for complete search history.

(56) References Cited

U.S. PATENT DOCUMENTS

| | | | | |
|---|---|---|---|---|
| 6,260,300 | B1 | 7/2001 | Klebes | |
| 2014/0196636 | A1* | 7/2014 | Deweese | E05G 1/04 109/23 |
| 2016/0053526 | A1* | 2/2016 | Dittrich | E05G 1/026 109/38 |

* cited by examiner

*Primary Examiner* — Leon Flores
(74) *Attorney, Agent, or Firm* — Wright Lindsey & Jennings LLP; Meredith Lowry

(57) ABSTRACT

The firearm storage receptacle for mount on a wall in a public environment with a loaded firearm encased inside is disclosed. When an active shooter or potential life or death situation should arise, an approved/authorized individual can access safely the firearm through biometric data recognition system while simultaneously contacting the local authorities in the area to alert that there is an active shooter in the facility. The firearm storage receptacle would also include a florescent colored spray applied to the personnel when opening the firearm storage receptacle to identify who is the protector and who is the assailant, thus eliminating the risk of an accidental shooting of the protector.

8 Claims, 6 Drawing Sheets

FIREARM STORAGE RECEPTACLE WITH ALERT NOTIFICATION FOR EMERGENCY PERSONNEL

CROSS-REFERENCE TO RELATED APPLICATIONS

This application claims priority to and is a continuation-in-part of U.S. Provisional Patent Application Ser. No. 62/299,079 filed on Feb. 24, 2016, the disclosure of which is hereby incorporated by reference in its entirety.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to the field of locking storage receptacles. In particular, to the field of storage receptacle for preventing unauthorized access to or use of a firearm.

2. Description of the Known Art

The present invention relates to locking storage receptacles and locking or disabling mechanisms and controls for firearms and other devices requiring secured access and, more particularly, to methods and apparatus for preventing unauthorized access to or use of a firearm or other article by securing the firearm or article in a safe box.

SUMMARY OF THE INVENTION

There is a desire to protect children and adults from active shooter situations while restricting access to a firearm during normal situations. It is an object of the present invention to provide a firearm storage receptacle that can store a firearm for access during an active shooter situation.

The firearm storage receptacle being proposed is intended to be used to safeguard our children, workers and innocent civilians from being without the protection of a firearm when and if an active shooter should invade the said environment.

The firearm storage receptacle which would be mounted on a wall in a public environment with a loaded firearm encased inside. When an active shooter or potential life or death situation should arise the approved/authorized personnel would place a thumb on a thumb pad or other biometric data recognition system which will simultaneously contact the local authorities in the area alerting them that there is an active shooter in the facility. The approved/authorized personnel would then enter a security code opening the firearm storage receptacle; the firearm storage receptacle would then communicate with the other firearm storage receptacles in the environment if more than one receptacle is in the facility, alerting them with LED lights on the application that there is an active shooter and on the keypad it would display as to what area the alert was activated.

The firearm storage receptacle would also include a florescent colored vegetable based spray that would spray the personnel when opening the firearm storage receptacle so that when the local authorities arrive on the scene they will easily be able to identify who is the protector and who is the assailant, thus eliminating the risk of an accidental shooting of the protector. It is an object of the present invention to identify the protector personnel from the assailant.

There is a need in multiple environments for this firearm storage receptacle, including public and private schools, retail locations, hospitals, government agencies, movie theaters, private sectors, gas stations, along with many others.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
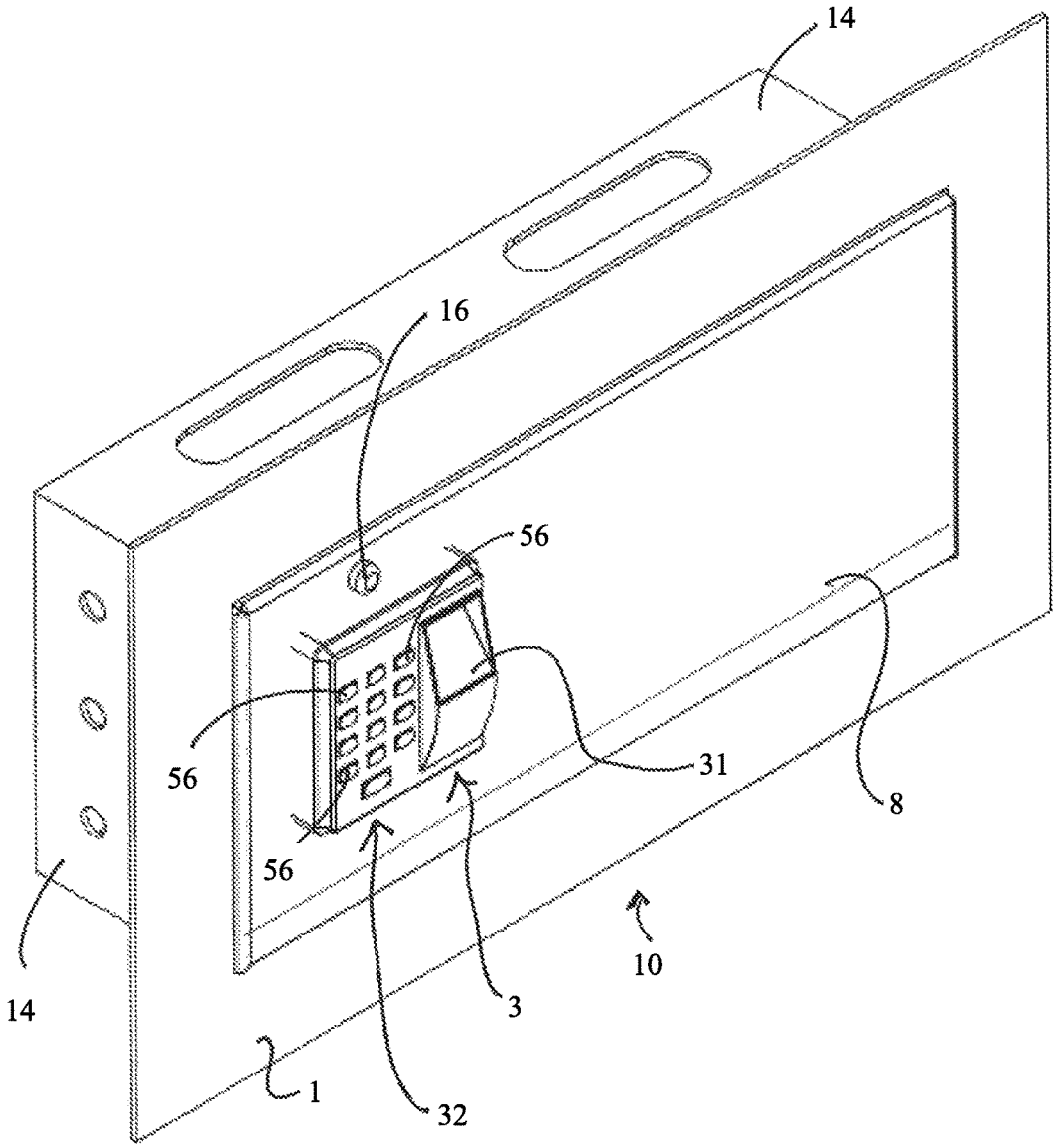
FIG. 1 is a perspective view of our invention.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

It will be understood that, although the terms first, second, etc. may be used herein to describe various elements, these elements should not be limited by these terms. These terms are only used to distinguish one element, from another element. For instance, a first element discussed below could be termed a second element without departing from the teachings of the present invention. Similarly, the second element could also be termed the first element.

The term "and/or" includes any and all combinations of one or more of the associated listed items. The terminology used herein is for the purpose of describing particular embodiments only and is not intended to be limiting. As used herein, the singular forms "a," "an" and "the" are intended to include the plural forms as well, unless the context clearly indicates otherwise.

It will be understood that when an element is referred to as being "coupled" or "connected" to another element, it can be directly coupled or connected to the other element or intervening elements may be present therebetween.

In contrast, it should be understood that when an element is referred to as being "directly coupled" or "directly connected" to another element, there are no intervening elements present.

It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, the term "aperture" includes but is not limited to holes, slits and combinations thereof.

The phrase "biometric" as used herein may encompass the act of authentication a person by one of his physical characteristics.

As used herein, the term "communications network" is to be interpreted broadly and includes, but is not limited to, local area networks, telecommunications networks, wide area networks, modem connections, etc. Typically, a communications network will comprise a physical component or physical connection that is made up of the wiring, interface cards and other hardware combined with a specified communications protocol to transmit information from one physical connection to another.

For simplicity, it is to be understood that the term "firearm" as used herein, includes not only pistols, handguns, and small arms, but also shotguns, long guns, rifles, and stun guns, such as a TASER® stun gun, available commercially from TASER International, Inc. in Scottsdale, Ariz. 85260.

As used herein, the term "microcontroller" means a controller on a single integrated circuit containing a processor core, memory, and programmable input/output peripherals.

As used herein, the term "portable electronic device" is any device having a processor, memory, and an operating system, capable of interaction with a user or other computer and which can be used for communication over a wireless communication networks, such as a cellular phone, a walkie-talkie, a personal digital assistant (PDA), a pager, a smart phone, or any combination thereof. Portable electronic devices operative in the present invention typically run a mobile software application to effect the functionality described herein.

As used herein, the terms "wireless communication" and "wirelessly communicate" generally refers to a transmission of communication signals, such as voice signals and/or data signals, between devices. For example, as described herein, a transceiver, may wirelessly communicate with a portable electronic device. In addition, as used herein, the term "wireless communication protocol" refers generally to a communications protocol that facilitates transmitting and receiving communications signals over a wireless connection. Examples of wireless communication protocols include Bluetooth®, Wi-fi, and ZigBee® (Bluetooth® is a registered trademark of Bluetooth SIG, Inc., Bellevue, Wash., USA, and ZigBee® is a registered trademark of ZigBee Alliance Corporation, San Ramon, Calif., USA). However, various embodiments of the invention may utilize alternative protocols.

Referring now to the drawings, in which like numerals represent like components throughout the several views, the preferred embodiments of the present invention are next described. The following description of one or more preferred embodiment(s) is merely exemplary in nature and is in no way intended to limit the invention, its application, or uses.

As shown in FIG. 1-7 of the drawings, one exemplary embodiment of the present invention is generally shown as a firearm storage receptacle 10 having hardware for transmitting a wireless communication signal to a communication network 200 capable of transmitting data to emergency personnel or portable electronic devices. By way of example, portable electronic device 100 can generally correspond to a device that can perform as a camera, music player, game player, video player, personal digital assistant (PDA), tablet computer and/or the like. The portable electronic device 100 includes a mechanism for wireless communications, as either a transceiver type device or receiver only, such as a radio, portable computing device 100 can include an antenna that can be disposed internal to a radio transparent portion of the housing of the device 100.

The firearm storage receptacle 10 includes a housing 1 enclosing a recess 11 containing the firearm 7 while the firearm 7 is stored and encasing a spray system 12. The receptacle 10 is intended to be placed in a cavity within a wall to limit access to the firearm to the door 8. In this manner, only authorized personnel will have access to the firearm.

Figure 2:
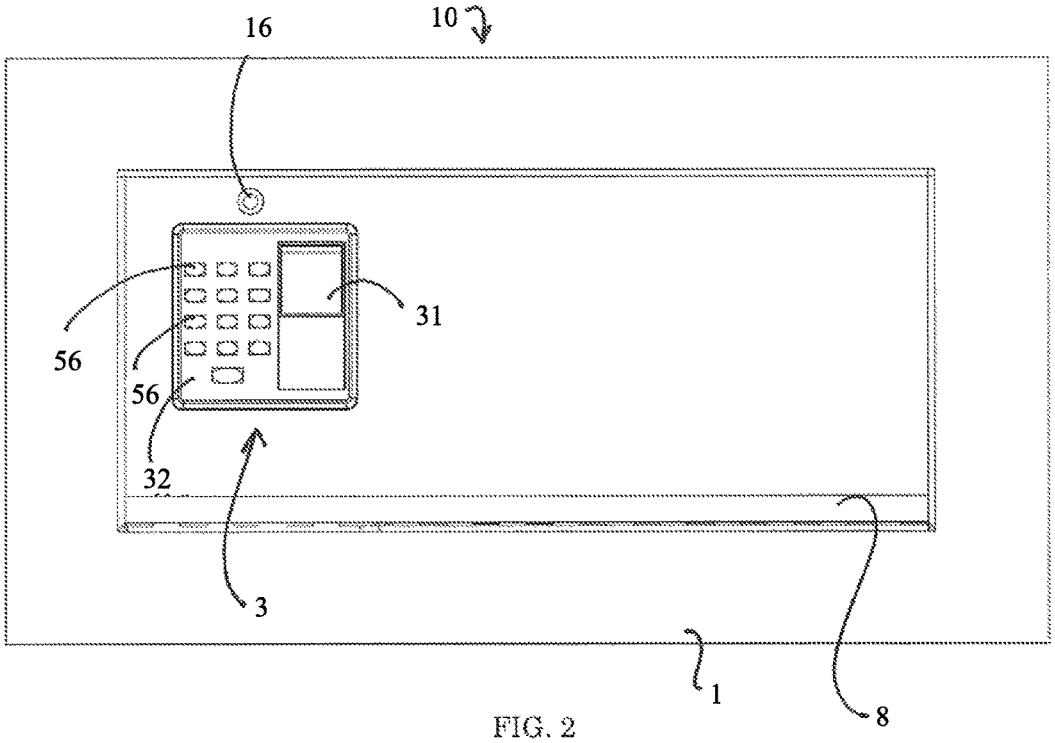
FIG. 2 is a front view of our invention.
Figure 3:
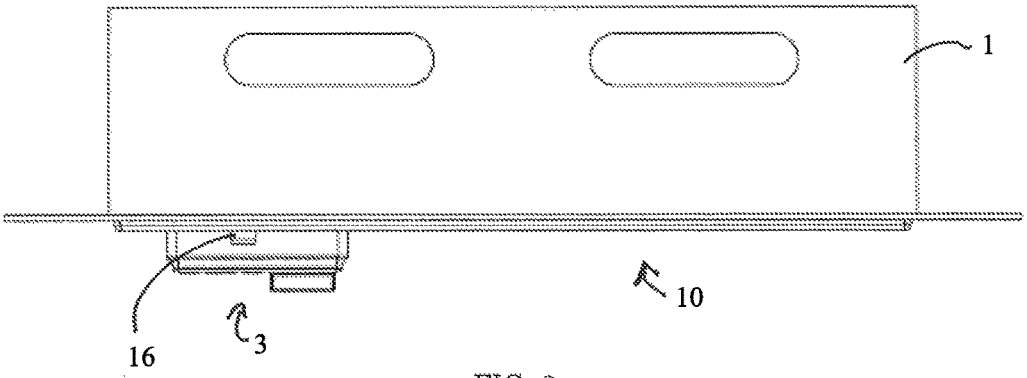
FIG. 3 is a top plan view of our invention.

As shown in FIGS. 1-3, the receptacle 10 includes multiple sides 14, with one side 14 providing a planar face for placement of a biometric data recognition system 3. The biometric data recognition system 3 is the first authentication point on the receptacle 10. The biometric data recognition system 3 shown utilizes fingerprint or thumbprint scanning device 31 or other biometric recognition systems available to authenticate the user of the device for access to the housing and the firearm held within. The biometric data recognition system 3 may operate by conventional means known in the art, such as by activating a solenoid (not shown) upon detecting an authorized fingerprint. In some examples, the solenoid may be disposed to displace a locking shaft 46 that engages or disengages with the locking mechanism 42, 44 of the receptacle 10. It is understood that other biometric systems, not limited to fingerprint or thumbprint systems, may be implemented with the present invention, including systems recognizing voice print data, retinal scan data, and iris scan data. For the purpose of this description, the term "fingerprint" shall collectively refer to both fingerprint and thumbprint unless specifically stated otherwise.

The biometric data recognition system 3 according to the present invention may utilizes a commercially available fingerprint scanner 31 such as the THOMSON-CSF SEMI-CONDUCTEURS SPECIFIQUES FINGERCHIP™. By integrating the biometric data recognition system 3 with appropriate hardware and software, a self-contained system for scanning and processing fingerprint data to control access to, or operation of, a firearm according to one of the preferred embodiments is achieved. An example of a suitable hardware/software system for this purpose is the OXFORD MICRODEVICES A236 VIDEO DIGITAL SIGNAL PROCESSOR CHIP. Other fingerprint-based or biometric authorization systems are commercially available and may be provided as suitable alternatives.

The firearm storage receptacle 10 contains a power supply (not shown) to provide power to the components of the receptacle 10 and communication system for accessing the internet 18 to allow the receptacle 10 to provide wireless communication to contact emergency personnel. The wireless communication system or wired communication system 18 is, for example, mobile telephony technology, where the user might be required to subscribe to a known carrier for accessing the internet. The communication system 18 could also comprise input/output connectors 30 on the housing of the receptacle 10. The port connections 30 may include standard connections such as an RJ-11 phone jack, an RJ-45 Ethernet jack, a USB port. In another embodiment, the communication system 18 may be access means that include a telephone connection that provides a signal to the authorities.

When an active shooter or potential life or death situation should arise the approved/authorized personnel would place a finger on the scanner 31 of the biometric data recognition system 3. Upon entry of valid biometric data into the data recognition system 3, the approved/authorized personnel would then access the second authentication point by entering a security code on a key pad 32 having multiple buttons 56, further validating the appropriate access to the firearm and thereby allowing release of the bolts 46 of locking mechanisms 42, 44 to allow release of the door 8 from the receptacle 10, thereby opening the firearm storage receptacle 10.

The locking mechanism 42, 44 is electronically connected to the wireless communication system 18. Alternatively, the communication system 18 is triggered by the movement of the door of the receptacle. Once the receptacle 10 is open, the communications system 18 provides an alert notification transmitted via a communications network 200 to a notified device such as a central server, network entity 225, mainframe computer system 250, or select portable electronic devices 275 to communicate to emergency personnel that access to the firearm 7 has been initiated and provides a visual alert to the user through activating a light bulb 16 on the outside of the receptacle 10. The alert notification transmitted may include data including GPS location of the receptacle 10, time of access, the accessor information, including physical description, name, and photograph identification.

The firearm storage receptacle 10 would then communicate using the internet access means 18 with the other firearm storage receptacles 10 in the environment if more than one receptacle is in the facility, alerting them with LED lights 16 on the receptacles 10 that there is an active shooter and on the keypad it would display as to what area the alert was activated.

The firearm storage receptacle 10 contains a spray system 12 having a reservoir 6 containing a quantity of a marking liquid, such as a florescent-colored or ultraviolet spray liquid (not shown), connected by tubing 22 to nozzles 2, 5 for application of the marking liquid. Upon entry of valid biometric data into the biometric data recognition system 3, data recognition system 3 or a component in electronic communication with the system 3 triggers an electronic or mechanical signal to the spray system 12. When the door 8 is moved downward, the spray system 12 recognizes the movement and is configured to release spray liquid into the tubing 22 to emit the spray liquid onto the personnel through from the nozzles 2, 5 when the personnel opens the firearm storage receptacle 10. In this manner, the personnel is marked with the spray liquid so that when the local authorities arrive on the scene they will easily be able to identify who is the protector and who is the assailant, thus eliminating the risk of an accidental shooting of the protector. In another embodiment, the receptacle 10 contains a reservoir 6 containing a quantity of florescent-colored or ultraviolet spray liquid (not shown) for manual application by the personnel upon access to the firearm.

Figure 4:
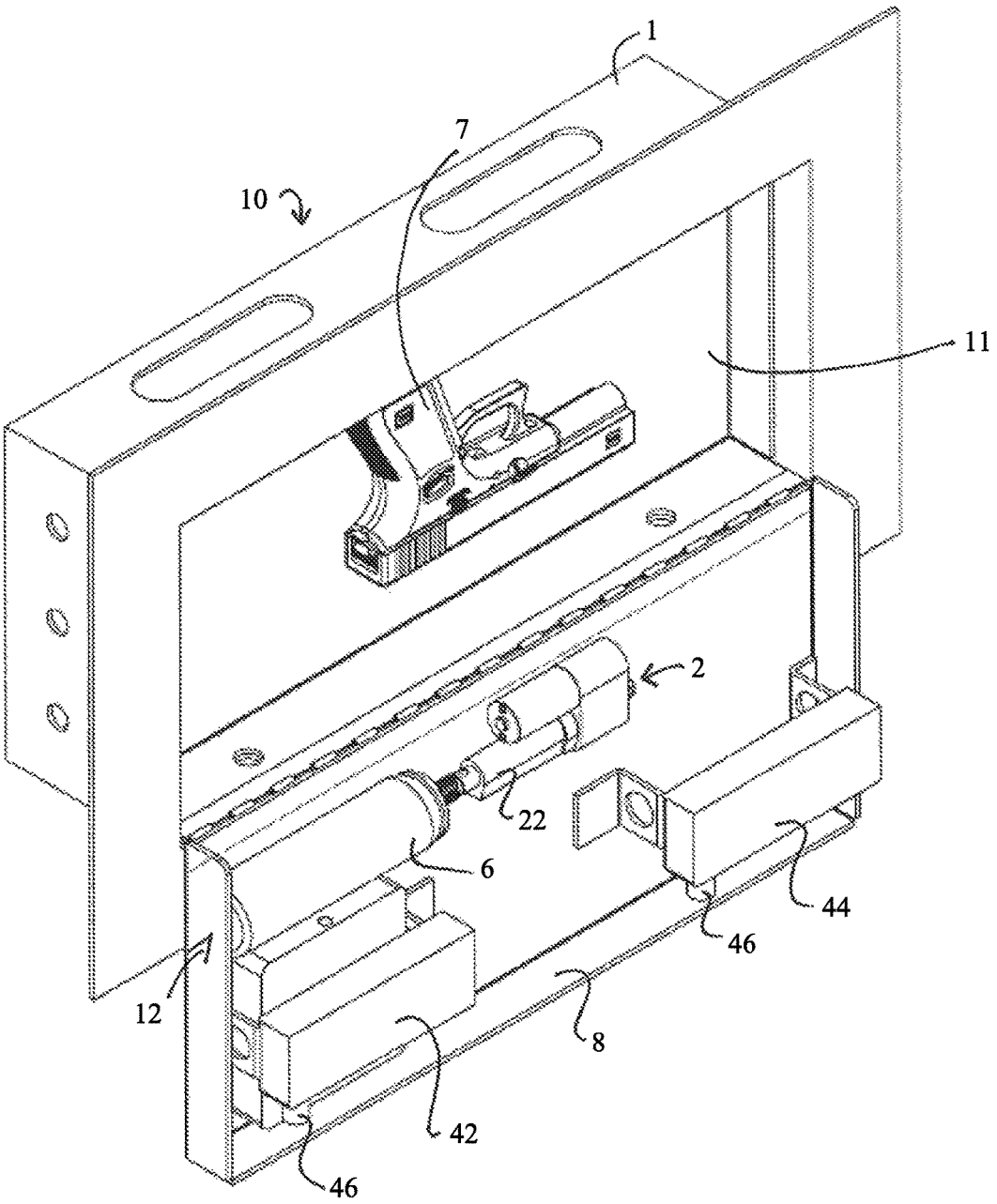
FIG. 4 is a perspective view of our invention, with the door of the firearm storage receptacle opened.
Figure 5:
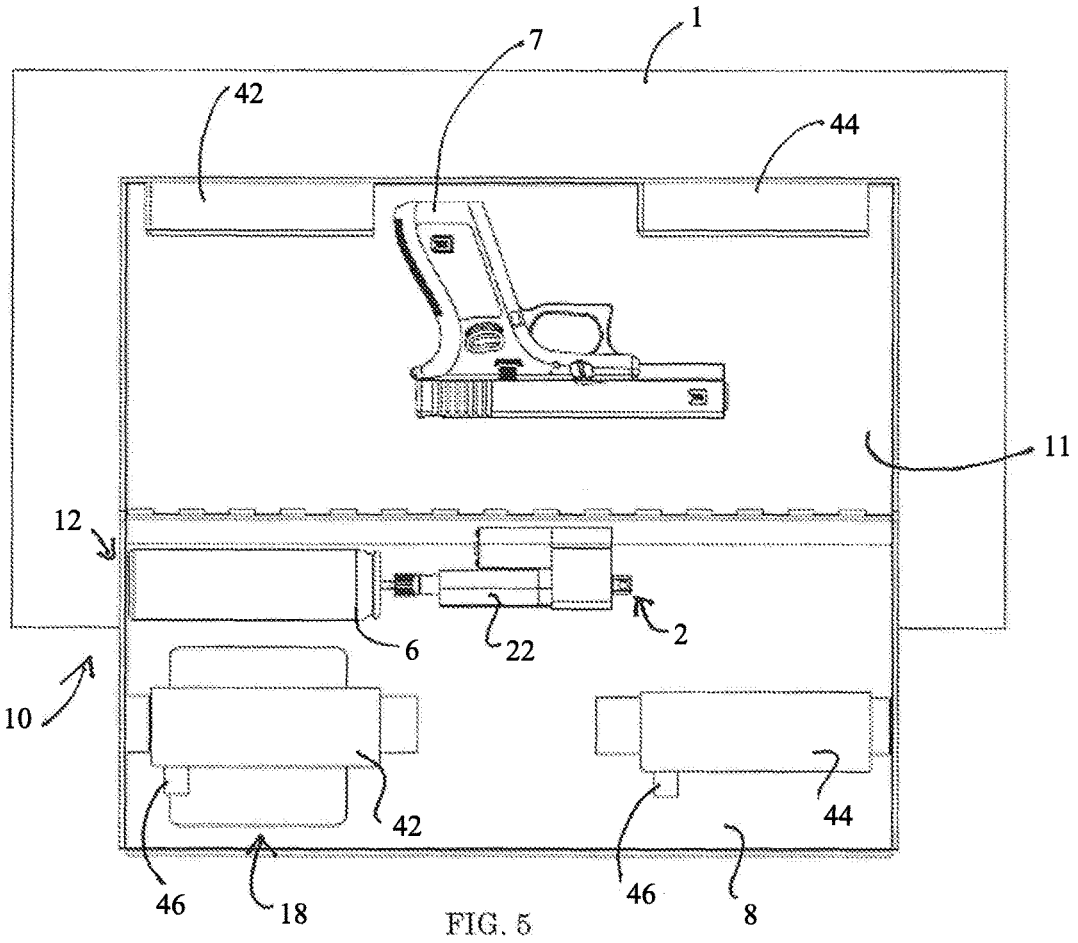
FIG. 5 is a front view of the same.
Figure 6:
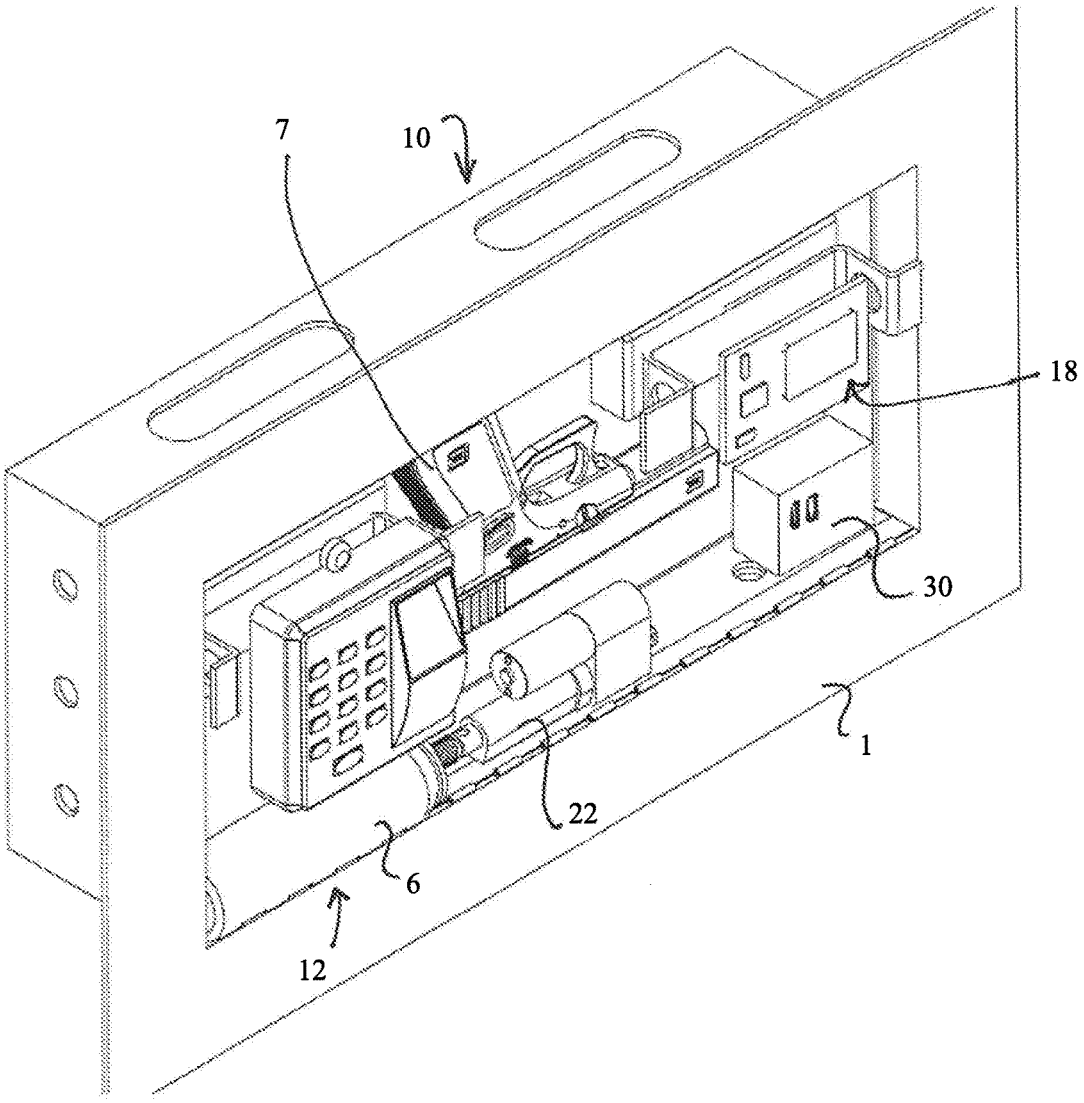
FIG. 6 is perspective view of our invention with the front door panel transparent.
Figure 7:
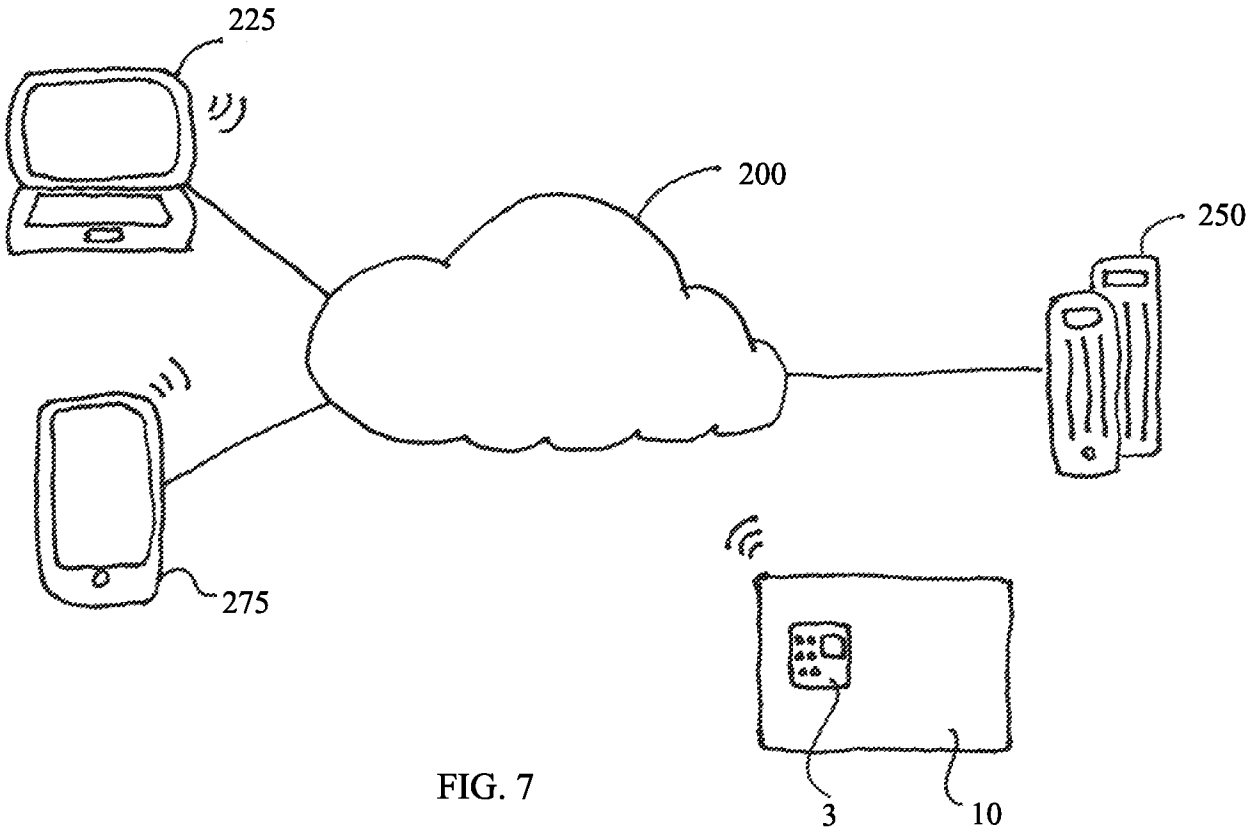
FIG. 7 is a schematic of our proposed invention in use.

When the biometric data is inputted into the biometric data recognition system 3 and the keycode is entered into the keypad 32, the storage receptacle 10 will eject the front 8 of the receptacle 10 from the first position (shown in FIG. 1) to the second position (shown in FIG. 4).

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically referring to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures.

What is claimed is:

1. A firearm storage receptacle capable of transmitting data to emergency personnel or portable electronic devices upon opening said firearm storage receptacle, said firearm storage receptacle comprising:

a housing enclosing a recess configured to store a firearm, said housing configured to fit in a wall opening, said housing further comprising a housing door configured to move between a locked position and an unlocked position and a door locking mechanism that moves between a locked position and an unlocked position;

a first access point terminal comprising a biometric recognition system having a biometric scanning device configured to authenticate an authorized personnel based on biometric information, said biometric information is chosen from a group consisting of fingerprint data, voice print data, retinal scan data and iris scan data;

a second access point terminal comprising a keypad device including a plurality of buttons;

a spray system contained within said housing, said spray system comprising a reservoir containing a quantity of a marking liquid and a nozzle for application of the marking liquid;

a communications system configured to contact emergency personnel upon access by authenticated authorized personnel, said communications system connected to a communications network and configured to provide an alert notification transmitted via said communications network to a notifying device, said notifying device chosen from a group consisting of a central server, a network entity, a mainframe computer system, or a portable electronic devices;

said transmitted alert notification comprising data chosen from a group consisting of Global Positioning System location of the receptacle, access time of the receptacle, and photographic identification of authenticated authorized personnel.

2. A firearm storage receptacle for securely restricting access to a firearm within a sensitive environment and capable of transmitting data to emergency personnel or portable electronic devices upon opening said firearm storage receptacle to notify others of an active shooter situation, said firearm storage receptacle comprising:

a housing enclosing a recess configured to store a firearm and having a housing door configured to move between a locked position and an unlocked position and a door locking mechanism that moves between a locked position and an unlocked position;

a first access point terminal comprising a biometric recognition system having a biometric scanning device configured to authenticate an authorized personnel based on biometric information, said biometric information is chosen from a group consisting of fingerprint data, voice print data, retinal scan data and iris scan data;

a spray system contained within said housing, said spray system comprising a reservoir containing a quantity of a marking liquid and a nozzle for application of the marking liquid;

a communications system configured to contact emergency personnel upon access by authenticated authorized personnel, said communications system connected to a communications network and configured to provide an alert notification transmitted via said communications network to a notifying device, said notifying device chosen from a group consisting of a central server, a network entity, a mainframe computer system, or a portable electronic devices;

said transmitted alert notification comprising data chosen from a group consisting of Global Positioning System location of the receptacle, access time of the receptacle, and photographic identification of authenticated authorized personnel.

3. The firearm storage receptacle of claim 2, further comprising a second access point terminal comprising a keypad device including a plurality of buttons.

4. A firearm storage receptacle for securely restricting access to a firearm within a sensitive environment and capable of transmitting data to emergency personnel or portable electronic devices upon opening said firearm storage receptacle to notify others of an active shooter situation, said firearm storage receptacle comprising:

a housing enclosing a recess configured to store a firearm and having a housing door configured to move between a locked position and an unlocked position and a door locking mechanism that moves between a locked position and an unlocked position;

a first access point terminal comprising a biometric recognition system having a biometric scanning device configured to authenticate an authorized personnel based on biometric information;

a spray system contained within said housing, said spray system comprising a reservoir containing a quantity of a marking liquid and a nozzle for application of the marking liquid; and a communications system configured to contact emergency personnel upon access by authenticated authorized personnel, said communications system connected to a communications network and configured to provide an alert notification transmitted via said communications network to a notifying device.

5. The firearm storage receptacle of claim 4, further comprising a second access point terminal comprising a keypad device including a plurality of buttons.

6. The biometric scanning device as set forth in claim 4, wherein said biometric information is chosen from a group consisting of fingerprint data, voice print data, retinal scan data and iris scan data.

7. The communications system as set forth in claim 4, wherein said notifying device is chosen from a group consisting of a central server, a network entity, a mainframe computer system, or a portable electronic devices.

8. The communications system as set forth in claim 4, wherein said transmitted alert notification comprises data chosen from a group consisting of Global Positioning System location of the receptacle, access time of the receptacle, and photographic identification of authenticated authorized personnel.

* * * * *